United States Patent [19]

Langr

[11] 4,379,397

[45] Apr. 12, 1983

[54] APPARATUS HAVING SHAPING JAWS FOR MANUFACTURING BODIES OF SPINDLE-TYPE SHAPES

[75] Inventor: Oldrich Langr, Olomouc, Czechoslovakia

[73] Assignee: Sigma concern, Olomouc, Czechoslovakia

[21] Appl. No.: 299,586

[22] Filed: Sep. 4, 1981

Related U.S. Application Data

[63] Continuation-in-part of Ser. No. 72,469, Sep. 4, 1979, abandoned.

[30] Foreign Application Priority Data

Sep. 1, 1978 [CS] Czechoslovakia ..... 5661-78
Sep. 4, 1978 [CS] Czechoslovakia ..... 5714-78

[51] Int. Cl.[3] ..... B21K 1/12

[52] U.S. Cl. ..... 72/95; 72/141; 72/402

[58] Field of Search ..... 72/76, 95, 98, 371, 72/402, 406, 383, 385, 141; 76/108; 29/156.8 R

[56] References Cited

U.S. PATENT DOCUMENTS

| | | | |
|---|---|---|---|
| 2,363,507 | 11/1944 | Dewey | 72/402 |
| 2,419,678 | 4/1947 | Duenas et al. | 72/76 |
| 2,505,623 | 4/1950 | McLaughlin et al. | 72/141 |
| 3,606,789 | 9/1971 | Kozusnik | 72/402 |

FOREIGN PATENT DOCUMENTS

| | | | |
|---|---|---|---|
| 594367 | 3/1934 | Fed. Rep. of Germany | 72/385 |

*Primary Examiner*—Lowell A. Larson

[57] ABSTRACT

Apparatus for making a spindle-type body with at least one eccentric zone from a semi-product of circular cross-section by gradually radially displacing the eccentric zone of the semi-product to bring its eccentricity from zero to the desired value. The apparatus includes a multi-part die with shaping jaws providing a semi-product shaping passage therein, the semi-product being thrust axially into the die while the semi-product and the die rotate relatively to each other.

2 Claims, 6 Drawing Figures

APPARATUS HAVING SHAPING JAWS FOR MANUFACTURING BODIES OF SPINDLE-TYPE SHAPES

This application is a continuation-in-part of application Ser. No. 72,469, filed Sept. 4, 1979, now abandoned.

This invention relates to apparatus having shaping jaws for manufacturing bodies of spindle-type shape of circular and cross-sections.

In the manufacture of bodies of the type above mentioned, it is known (Kozusnik, U.S. Pat. No. 3,606,789) to use a drawing die consisting of a body having a conical cavity therein, the body containing shaping jaws provided with a continuous cavity having an inlet portion and a calibration portion of the shape of the spindle to be formed, such die having inlet and outlet apertures in the parts adjacent to the jaws, e.g. in a pressure insert, in a support, in an elastic lifting device for the jaws, or in a base plate. The shaping jaws are operated in a closing direction by the action of a press, and in the opening direction, by means of elastic elements. The starting tubular semi-finished product is gradually fed forward in such direction as to be engaged in the shaping apparatus now being continuously rotated about its longitudinal axis. During its forward motion through the shaping device the semi-product is pressed in a radially inward direction by means of the shaping jaws of the die. Because of the fact that the tubular semi-product is immediately radially pressed in each step to its final eccentricity, this so-called "cold-forming" must be conducted in more than one operation; this results in increasing both the production time and the cost of production. A further disadvantage of the known apparatus resides in the fact that the initial phases of the shaping of the semi-product are conducted within an inlet part of the die which is not closed.

The present invention has among its objects the provision of an improved and relatively simple shaping jaws by means of, such jaws the whole process taking place in a relatively simple manner inside a shaping cavity which is closed along its entire circumference while the eccentricity of the tubular semi-product is being gradually increased.

When a spindle-type body of circular cross-section is to be manufactured, the continuous cavity of the shaping elements is provided with a forming part, the eccentricity of which gradually changes in magnitude from zero to the final desired value.

The invention will be more readily understood upon consideration of the accompanying drawings, in which.

Figure 3:
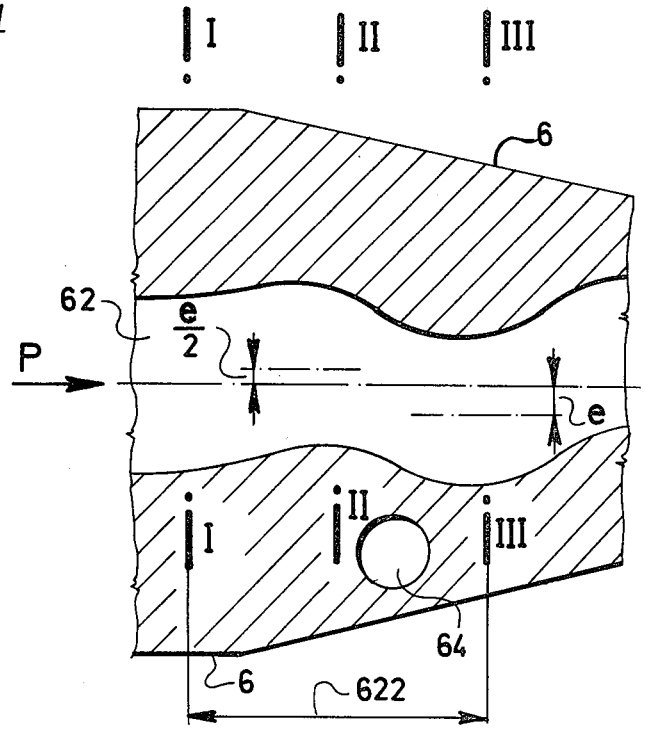
FIG. 3 is a fragmentary view on an enlarged scale of the forming part of the continuous cavity within the apparatus of FIGS. 1 and 2.
Figure 4A:
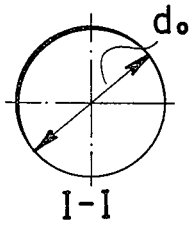
Figure 4B:
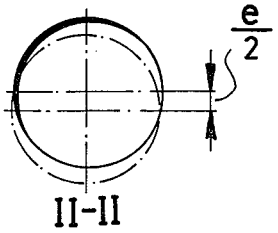
Figure 4C:
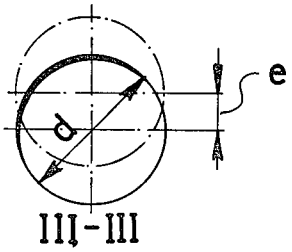

FIG. 4*a* is a diagram showing the shape of the cavity in FIG. 3 along the line I—I in that figure;

FIG. 4*b* is a similar cross-sectional view of the cavity at the location of the line II—II in FIG. 3;

FIG. 4*c* is a similar cross-sectional view of the shape of the cavity in FIG. 3 at the location of the line III—III in that figure.

As above noted, in the apparatus of FIGS. 1–4*c*, incl., a spindle-type body with a circular cross-section is manufactured from a tubular semi-product of circular cross-section by gradually displacing the circular cross-section of the tubular semi-product radially while its eccentricity increases gradually from zero to the required value.

Figure 1:
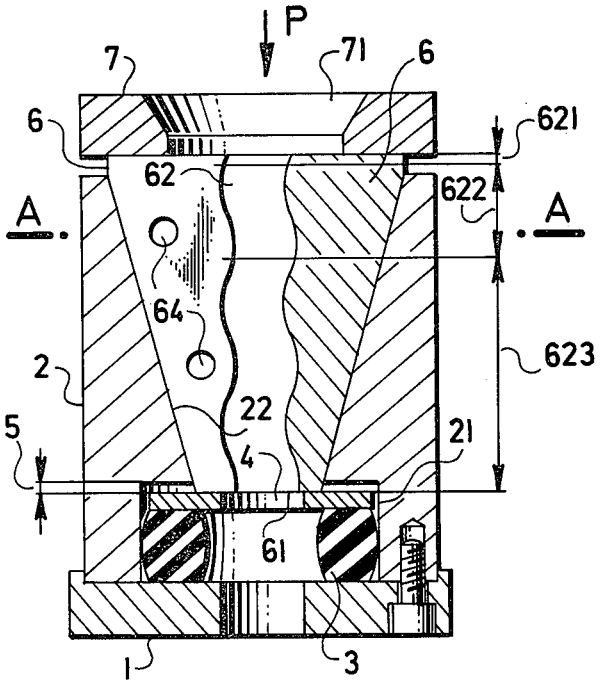
FIG. 1 is a view in longitudinal cross-section through the first embodiment of apparatus in accordance with the invention.
Figure 2:
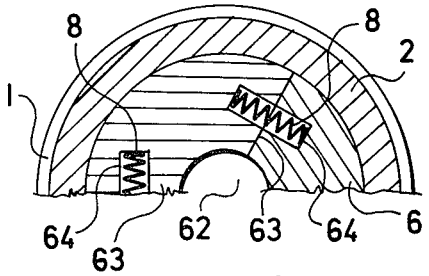
FIG. 2 is a fragmentary view in cross-section through the apparatus of FIG. 1, the section being taken along line A—A in FIG. 1.

As shown in FIGS. 1 and 2, the apparatus has a base plate 1 to which a body 2, which may be of circular cylindrical form, is connected, for example, by means of machine screws, as shown. The end of the body 2 adjacent the base plate 1 is provided with a cylindrical recess 21, the recess 21 being interposed between the base plate 1 and the lower, smaller-diameter end of a frusto-conical seat or cavity 22 in the body 2. The cylindrical recess 21 accommodates an annular elastic element 3, there being an annular supporting plate 4 disposed in recess 21 on top of lifting element 3.

A plurality of similar shaping jaws 6, which when pressed together form a body of frusto-conical shape complementary to the cavity 22 are disposed therein. In the apparatus shown, there are three such shaping jaws 6. An annular pressure insert 7 rests upon the upper, larger diameter end of the body formed by shaping jaws 6, pressure insert 7 being under the action of a press (not shown) which thrusts the shaping jaws 6 downwardly as shown in FIG. 1, so that the lower faces 61 of the shaping jaws 6 in turn thrust the plate 4 downwardly against the restoring or lifting force exerted by the elastic element 3. When the shaping jaws 6 are thus thrust downwardly, their radial side surfaces 63 are thrust into engagement, as shown in FIG. 2, against the opposition of coil compression springs 8 which are seated in confronting aligned bores 64 in successive shaping jaws 6. As is evident in FIG. 2, when the shaping jaws 6 are in the position there shown, there is presented a smooth passage or cavity 62 through the body formed by the shaping jaw 6. When pressure is relieved from the pressure insert 7 the elastic element 3 acting through the supporting plate 4 thrusts the shaping jaws 6 upwardly until the upper surface of pressure plate 4 engages the upper horizontal end surface of the recess 21. Such action, taken with that of the springs 8, thrusts the shaping jaws 6 apart, thereby to enlarge the diameter of the passage 62 through the forming device and to free them from the formed workpiece. The forming device has a funnel-shaped member 71 at its entrance end.

The continuous cavity 62 has an inlet part 621 followed by a forming part 622 and a calibration part 623, such parts merging smoothly in that order. As shown in FIGS. 1 and 3, the continuous cavity 62 has a spindle-type course and along its whole length has a circular cross-section. The size of the cross-section of the continuous cavity 62 changes from the inlet part 621 to the calibration part 623, while the magnitude of the inlet diameter $d_o$ and the calibration diameter d have the relationship:

$$d_o=(d\times L)/s$$

where s=the lead of the helical line of the continuous cavity 62 of the shaping elements 6, and L=the length of the helical line of the center of the circular cross-section, taken on its path distance of one lead.

The eccentricity e of the continuous cavity 62 increases gradually from zero to its final value. The magnitude of e is given by the relationship:

$$e=(s\ tg\alpha)/2\pi$$

where $\alpha$ = the helix angle of the helical line in degrees.

In the use of the above-described device, a tubular semi-product is thrust into the forming device in the axial direction P, the semi-product rotating relative to the forming device as it passes therethrough.

The tubular semi-product during its rotation around its longitudinal axis is forced by the action of the press in step-sequence in the direction of the arrow P between the shaping jaws 6. Because of the press-load acting on the pressure insert 7 the jaws 6 shift axially and move together radially into the position shown in FIG. 2. The backward motion of the jaws 6 is provided by the action of the elastic shifting element 3 via supporting place 4 within the time period when the press is out of action. Also during this backward motion the jaws 6 slide along the surface of the conical cavity 22 of the body 2 due to the action of the elastic pressure devices 8 resulting in the opening of the shaping elements or jaws 6. During the opening of the shaping jaws 6 even the treated tubular semi-product is released. During the following stroke of the press, the tubular semi-product is clamped again, and is shifted in the forward direction in one step, in which it is simultaneously radially reshaped. It is to be noted that the shaped product can extend outwardly through the central openings in plate 4 and the base plate 1.

With solids of circular cross-section such as, for example, the rotor of a single-screw pump, the optimum course of the shaping has been based upon the equation $$\pi \cdot d \cdot L = \pi \cdot d_o \cdot s$$

in which d—the so-called calibration diameter—is the final outer diameter of rotor cross-section perpendicular to the longitudinal rotor axis, which diameter corresponds to the diameter of cross-section of the calibration cavity in the calibration tool portion;

L is the length of helix comprising centers of the final rotor shape cross-section, which length corresponds to that comprising centers of the shaping cavity circular cross-sections in calibration tool portion taken on its path in the distance of one lead s of the helix;

$d_o$ is the inlet diameter of the overshaping or reshaping portion and is the diameter of the shaping cavity of the tool in the region where the eccentricity e is converting from $e=0$ to $e>0$;

s—lead of the helix of the through cavity of the shaping jaws—is the shortest distance between the cross-sections of the tool cavity or between the rotor cross-sections in the same angular positions of said cross-sections relative to the longitudinal axis of, e.g., the rotor.

The above-mentioned relation is based on the condition that the area of the external surface of the cylindrical part of the semi-product over the length of the lead of the spindle-type body is made equal to the area of the external surface of the finally manufactured spindle-type body over the same length of the lead of said spindle-type body.

Because of the continuous displacement of the eccentricity of the circular cross-section of the spindle-type body from zero to its final value, the tubular semi-product takes the required shape in one operation.

The shaping jaws of the apparatus are adapted for the cold forming or shaping of malleable metals, particularly the shaping of semi-products which are initially in the form of circular cylindrical tubular bodies. As above indicated, the apparatus can be used to form a plurality of serially connected shaped bodies from a single elongated semi-product, each of the shaped bodies being shaped in a single, continuous press operation.

Although the invention is illustrated and described with reference to a plurality of preferred embodiments thereof, it is to be expressly understood that it is in no way limited to the disclosure of such a plurality of preferred embodiments, but is capable of numerous modification within the scope of the appended claims.

I claim:

1. Apparatus for manufacturing spindle-type bodies of circular cross-section from a tubular semi-product, said apparatus comprising at least three shaping jaws which are periodically pressed together and apart in the direction transverse to the longitudinal axis of the manufactured body, said shaping jaws forming a continuous passage having an inlet part, a shaping part and a calibrating part, the shaping part being formed as a cavity of circular cross-section the center of which lies at the inlet of the shaping part and coincides with the axis of the inlet part, the center, which trails the calibrating part, lying on a spiral the lead of which corresponds to the lead of the manufactured body, the eccentricity of the spiral increasing along the whole length of the shaping part continuously from zero to the value corresponding to the eccentricity of the spindle of the manufactured body.

2. Apparatus according to claim 1, wherein the value of the diameter $d_o$ of the inlet part of the continuous passage and the value of the diameter of the calibrating part of the continuous passage has the relationship:

$$d_o=(d\ L)/s$$

wherein s equals the lead of the helical line of the continuous passage formed by the shaping jaws, and L equals the length of the helical line of the center of the circular cross-section, taken on its path in the distance of one lead.

* * * * *